US007777684B2

(12) United States Patent
Rao et al.

(10) Patent No.: US 7,777,684 B2
(45) Date of Patent: Aug. 17, 2010

(54) MULTI-BAND SLOT-STRIP ANTENNA

(75) Inventors: Qinjiang Rao, Waterloo (CA); Geyi Wen, Waterloo (CA); Mark Pecen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 462 days.

(21) Appl. No.: 11/688,052

(22) Filed: Mar. 19, 2007

(65) Prior Publication Data

US 2008/0231532 A1 Sep. 25, 2008

(51) Int. Cl.
*H01Q 13/10* (2006.01)

(52) U.S. Cl. ..... 343/770

(58) Field of Classification Search ..... 343/700 MS, 343/767, 770

See application file for complete search history.

(56) References Cited

U.S. PATENT DOCUMENTS

| | | | |
|---|---|---|---|
| 6,677,909 | B2 | 1/2004 | Sun et al. |
| 7,006,048 | B2 | 2/2006 | Chang |
| 2004/0085244 | A1 | 5/2004 | Kadambi et al. |
| 2007/0040745 | A1 | 2/2007 | Chen et al. |
| 2007/0040747 | A1 | 2/2007 | Kinezos |

FOREIGN PATENT DOCUMENTS

| | | | |
|---|---|---|---|
| EP | 0923156 | A1 | 6/1999 |
| EP | 1304765 | A2 | 4/2003 |
| WO | 2004049501 | A1 | 6/2004 |

OTHER PUBLICATIONS

Kadambi G R et al: "Applications of annular and L-shaped slot in PIFA design" IEEE Antennas and Propagation Society International Symposium, 2003 Digest, APS. Columbus, OH, Jun. 22-27, 2003, New York, NY: IEEE, US, vol. 4 of 4, Jun. 22, 2003, p. 86, XP010747200; ISBN: 0-7803-7846-6, the whole document.

*Primary Examiner*—Michael C Wimer
(74) *Attorney, Agent, or Firm*—Heenan Blaikie LLP

(57) ABSTRACT

A multi-band antenna includes a planar conductive layer that comprises a conductive region and a non-conductive region. The conductive region and the non-conductive region together define a first slot-strip structure, a second slot-strip structure coupled to the first slot-strip structure, and a third slot-strip structure coupled to the second slot-strip structure. The first slot-strip structure includes a signal feed portion. The second slot-strip structure includes a first signal grounding portion. The third slot-strip structure includes a second signal grounding portion.

20 Claims, 8 Drawing Sheets

300

300

MULTI-BAND SLOT-STRIP ANTENNA

FIELD OF THE INVENTION

The invention described herein relates to a multi-band antenna for a handheld wireless communications device. In particular, the invention relates to a multi-band slot-strip antenna.

BACKGROUND OF THE INVENTION

Slot antennas typically comprise a slot cut into a metal sheet or printed circuit board. Since some modern communication devices are required to operate in multiple frequency bands, multi-band slot antennas have been developed for use in such devices.

For instance, Chang (U.S. Pat. No. 7,006,048) describes a dual-band slot antenna for satellite and/or RFID communication systems. The slot antenna comprises two interconnected L-shaped slot antenna structures, and a printed circuit feed line that is coupled to both of the L-shaped slot antenna structures. Sun (U.S. Pat. No. 6,677,909) describes dual-band slot antenna that comprises a pair of meandering slots, and a coaxial feed cable that is connected to the meandering slots.

Planar inverted-F antennas (PIFA) are becoming increasingly common in wireless handheld communication devices due to their reduced size in comparison to conventional microstrip antenna designs. Therefore, PIFA antennas have been developed which include multiple resonant sections, each having a respective resonant frequency. However, since conventional PIFA antennas have a very limited bandwidth, broadband technologies, such as parasitic elements and/or multi-layer structures, have been used to modify the conventional PIFA antenna for multi-band and broadband applications.

These approaches increase the size of the antenna, making the resulting designs unattractive for modern handheld communication devices. Also, the additional resonant branches introduced by these approaches make the operational frequencies of the antennas difficult to tune. Further, the additional branches can introduce significant electromagnetic compatibility (EMC) and electromagnetic interference (EMI) problems.

SUMMARY OF THE INVENTION

According to the invention described herein, a multi-band antenna comprises at least three slot-strip structures configured with multiple ground pins.

In accordance with a first aspect of the invention, there is provided a multi-band slot-strip antenna that comprises a planar conductive layer comprising a conductive region and a non-conductive region. The conductive region and the non-conductive region together define a first slot-strip structure, a second slot-strip structure coupled to the first slot-strip structure, and a third slot-strip structure coupled to the second slot-strip structure. The first slot-strip structure comprises a signal feed portion. The second slot-strip structure includes a first signal grounding portion. The third slot-strip structure comprises a second signal grounding portion.

In accordance with a second aspect of the invention, there is provided a wireless communication device that comprises a radio transceiver section, and a multi-band slot-strip antenna coupled to the radio transceiver section. The multi-band slot-strip antenna comprises a planar conductive layer comprising a conductive region and a non-conductive region. The conductive region and the non-conductive region together define a first slot-strip structure, a second slot-strip structure coupled to the first slot-strip structure, and a third slot-strip structure coupled to the second slot-strip structure. The first slot-strip structure comprises a signal feed portion. The second slot-strip structure includes a first signal grounding portion. The third slot-strip structure comprises a second signal grounding portion. The signal feed portion is coupled to the radio transceiver section.

In accordance with a third aspect of the invention, there is provided a multi-band slot-strip antenna that comprises a planar conductive layer comprising a conductive region and a non-conductive region. The conductive region and the non-conductive region together define a plurality of mutually-coupled slot-strip structures. The slot-strip antenna also comprises a feed signal pin connected to one of the slot-strip structures, and a ground pin connected to the other slot-strip structures.

As will become apparent, in addition to a higher frequency band around 5 GHz for WLAN 802.11 j/a applications, the multi-band antenna offers enhanced low frequency bandwidth around 2 GHz for 3G communications, from a structure whose size is suitable for incorporation into small handheld communications devices.

BRIEF DESCRIPTION OF THE DRAWINGS

The invention will now be described, by way of example only, with reference to the accompanying drawings, in which.

DETAILED DESCRIPTION OF THE PREFERRED EMBODIMENT

Figure 1:
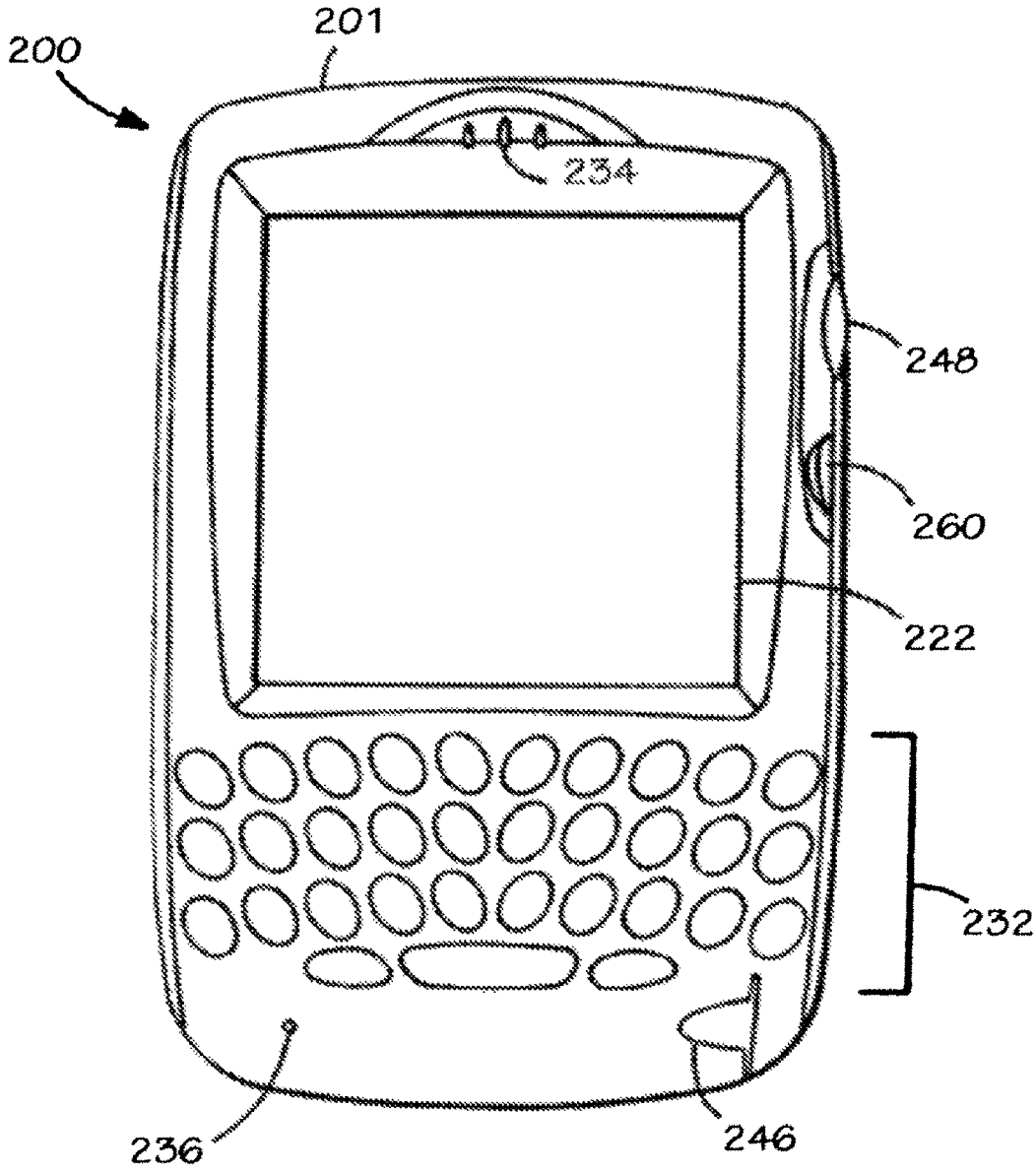
FIG. 1 is a front plan view of a handheld communications device according to the invention.

Turning to FIG. 1, there is shown a sample handheld communications device 200 in accordance with the invention. Preferably, the handheld communications device 200 is a two-way wireless communications device having at least voice and data communication capabilities, and is configured to operate within a wireless cellular network. Depending on the exact functionality provided, the wireless handheld communications device 200 may be referred to as a data messaging device, a two-way pager, a wireless e-mail device, a cellular telephone with data messaging capabilities, a wireless Internet appliance, or a data communication device, as examples.

As shown, the handheld communications device 200 includes a display 222, a function key 246, and data processing means (not shown) disposed within a common housing 201. The display 222 comprises a backlit LCD display. The data processing means is in communication with the display 222 and the function key 246. In one implementation, the backlit display 222 comprises a transmissive LCD display, and the function key 246 operates as a power on/off switch.

Alternately, in another implementation, the backlit display 222 comprises a reflective or trans-reflective LCD display, and the function key 246 operates as a backlight switch.

In addition to the display 222 and the function key 246, the handheld communications device 200 includes user data input means for inputting data to the data processing means. As shown, preferably the user data input means includes a keyboard 232, a thumbwheel 248 and an escape key 260. The keyboard 232 includes alphabetic and numerical keys, and preferably also includes a "Send" key and an "End" key to respectively initiate and terminate voice communication. However, the data input means is not limited to these forms of data input. For instance, the data input means may include a trackball or other pointing device instead of (or in addition to) the thumbwheel 248.

Figure 2:
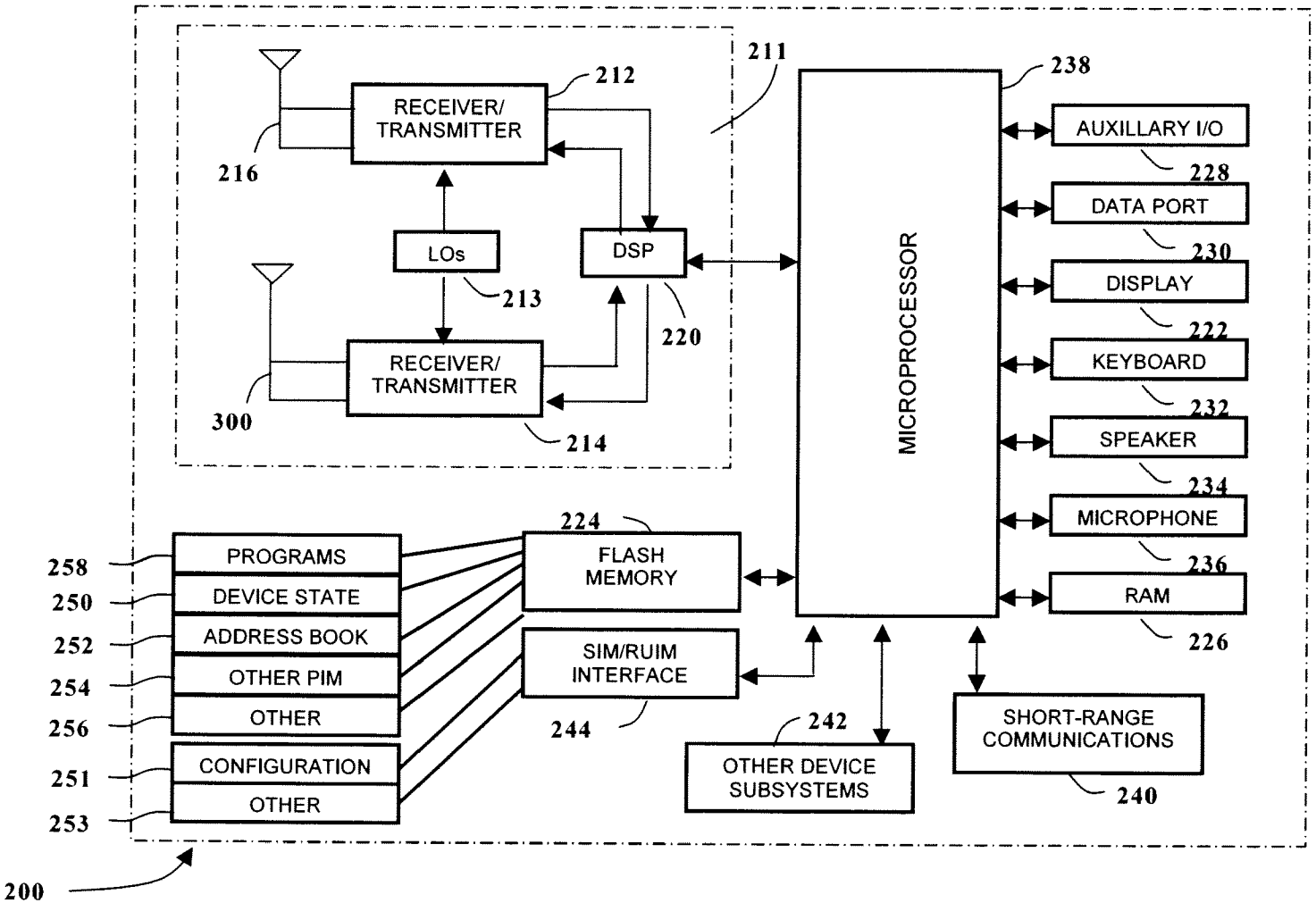
FIG. 2 is a schematic diagram depicting certain functional details of the handheld communications device.

FIG. 2 depicts functional details of the handheld communications device 200. As shown, the handheld communications device 200 incorporates a motherboard that includes a communication subsystem 211, and a microprocessor 238. The communication subsystem 211 performs communication functions, such as data and voice communications, and includes a primary transmitter/receiver 212, a secondary transmitter/receiver 214, a primary internal antenna 216 for the primary transmitter/receiver 212, a secondary internal antenna 300 for the secondary transmitter/receiver 214, and local oscillators (LOs) 213 and one or more digital signal processors (DSP) 220 coupled to the transmitter/receivers 212, 214.

Typically, the communication subsystem 211 sends and receives wireless communication signals over a wireless cellular network via the primary transmitter/receiver 212 and the primary internal antenna 216. Further, typically the communication subsystem 211 sends and receives wireless communication signals over a local area wireless network via the secondary transmitter/receiver 214 and the secondary internal antenna 300.

Preferably, the primary internal antenna 216 is configured for use within a Global System for Mobile Communications (GSM) cellular network or a Code Division Multiple Access (CDMA) cellular network. Further, preferably the secondary internal antenna 300 is configured for use within a Universal Mobile Telecommunications Service (UMTS) or WLAN WiFi (IEEE 802.11x) network. More preferably, the secondary internal antenna 300 is a multi-band slot-strip antenna that is configured for use with networks whose operational frequencies are at/near 2 GHz and 5 GHz, and whose low frequency bandwidth is suitable for 3G communications and high frequency band for WLAN 802.11 j/a applications. Although the handheld communications device 200 is depicted in FIG. 2 with two antennas, it should be understood that the handheld communications device 200 may instead comprise only a single antenna, with the multi-band slot-strip antenna 300 being connected to both the primary transmitter/receiver 212 and the secondary transmitter/receiver 214. Further, although FIG. 2 depicts the multi-band antenna 300 incorporated into the handheld communications device 200, the multi-band antenna 300 is not limited to mobile applications, but may instead by used with a stationary communications device. The preferred structure of the multi-band antenna 300 will be discussed in detail below, with reference to FIGS. 3 to 8.

Signals received by the primary internal antenna 216 from the wireless cellular network are input to the receiver section of the primary transmitter/receiver 212, which performs common receiver functions such as frequency down conversion, and analog to digital (A/D) conversion, in preparation for more complex communication functions performed by the DSP 220. Signals to be transmitted over the wireless cellular network are processed by the DSP 220 and input to transmitter section of the primary transmitter/receiver 212 for digital to analog conversion, frequency up conversion, and transmission over the wireless cellular network via the primary internal antenna 216.

Similarly, signals received by the secondary internal antenna 300 from the local area wireless network are input to the receiver section of the secondary transmitter/receiver 214, which performs common receiver functions such as frequency down conversion, and analog to digital (A/D) conversion, in preparation for more complex communication functions performed by the DSP 220. Signals to be transmitted over the local area wireless network are processed by the DSP 220 and input to transmitter section of the secondary transmitter/receiver 214 for digital to analog conversion, frequency up conversion, and transmission over the local area wireless network via the secondary internal antenna 300. If the communication subsystem 211 includes more than one DSP 220, the signals transmitted and received by the secondary transmitter/receiver 214 would preferably be processed by a different DSP than the primary transmitter/receiver 212.

The communications device 200 also includes a SIM interface 244 if the handheld communications device 200 is configured for use within a GSM network, and/or a RUIM interface 244 if the handheld communications device 200 is configured for use within a CDMA network. The SIM/RUIM interface 244 is similar to a card-slot into which a SIM/RUIM card can be inserted and ejected like a diskette or PCMCIA card. The SIM/RUIM card holds many key configurations 251, and other information 253 including subscriber identification information, such as the International Mobile Subscriber Identity (IMSI) that is associated with the handheld communications device 200, and subscriber-related information.

The microprocessor 238, in conjunction with the flash memory 224 and the RAM 226, comprises the aforementioned data processing means and controls the overall operation of the device. The data processing means interacts with device subsystems such as the display 222, flash memory 224, RAM 226, auxiliary input/output (I/O) subsystems 228, data port 230, keyboard 232, speaker 234, microphone 236, short-range communications subsystem 240, and device subsystems 242. The data port 230 may comprise a RS-232 port, a Universal Serial Bus (USB) port or other wired data communication port.

As shown, the flash memory 224 includes both computer program storage 258 and program data storage 250, 252, 254 and 256. Computer processing instructions are preferably also stored in the flash memory 224 or other similar non-volatile storage. Other computer processing instructions may also be loaded into a volatile memory such as RAM 226. The computer processing instructions, when accessed from the memory 224, 226 and executed by the microprocessor 238 define an operating system, computer programs, operating system specific applications. The computer processing instructions may be installed onto the handheld communications device 200 upon manufacture, or may be loaded through the cellular wireless network, the auxiliary I/O subsystem 228, the data port 230, the short-range communications subsystem 240, or the device subsystem 242.

The operating system allows the handheld communications device 200 to operate the display 222, the auxiliary input/output (I/O) subsystems 228, data port 230, keyboard 232, speaker 234, microphone 236, short-range communications subsystem 240, and device subsystems 242. Typically, the computer programs include communication software that configures the handheld communications device 200 to receive one or more communication services. For instance, preferably the communication software includes internet browser software, e-mail software and telephone software that respectively allow the handheld communications device 200 to communicate with various computer servers over the internet, send and receive e-mail, and initiate and receive telephone calls.

Figure 3:
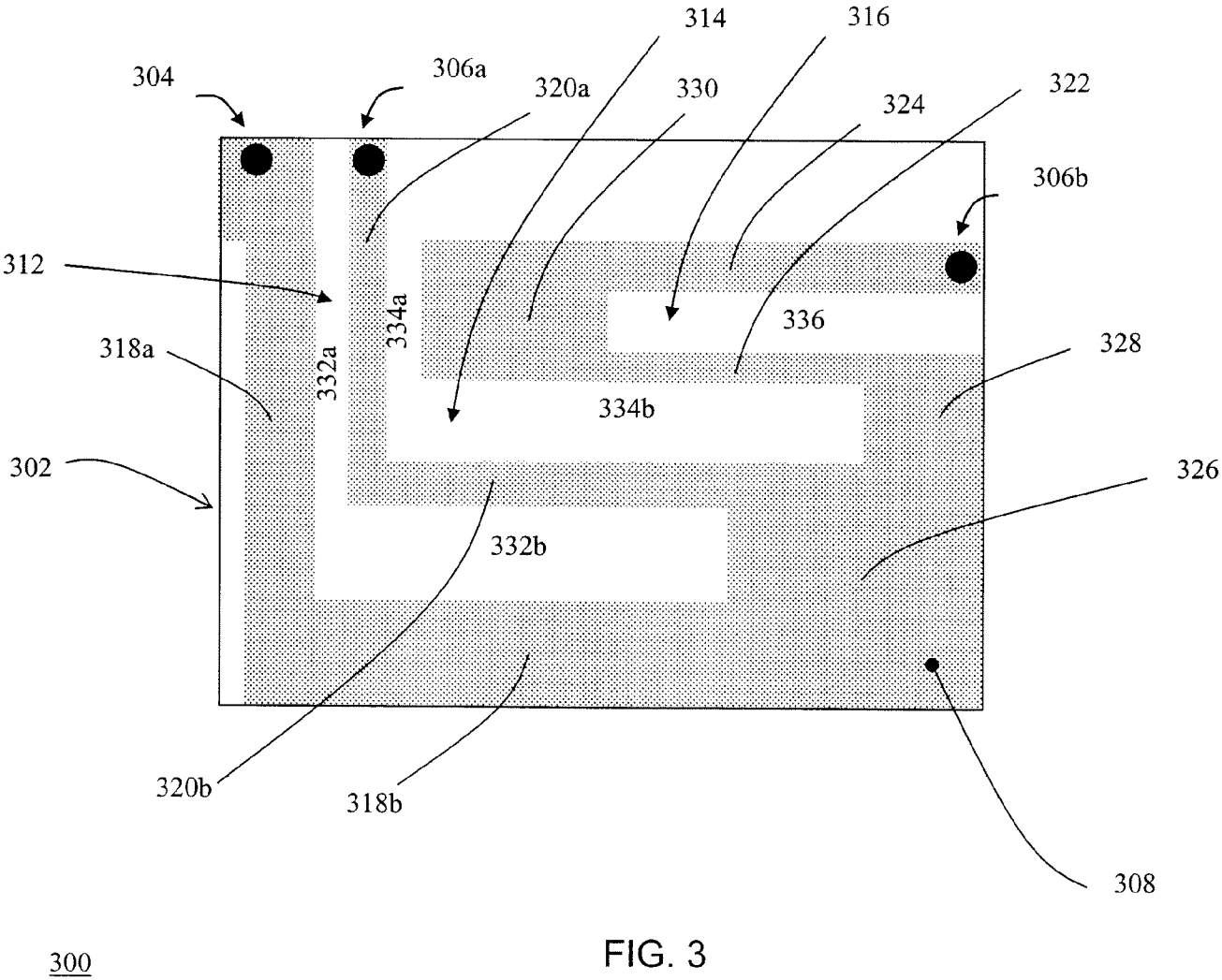
FIG. 3 is a top plan view of a multi-band slot-strip antenna of the handheld communications device, suitable for use with a wireless network.

FIG. 3 depicts the preferred structure for the multi-band slot-strip antenna 300. The secondary antenna 300 comprises a planar conductive layer 302. Preferably, the planar conductive layer 302 is disposed on a substrate layer (not shown). As shown, the conductive layer 302 has a substantially rectangular shape having two opposing pairs of substantially parallel edges. Preferably, the multi-band slot-strip antenna 300 is implemented as a printed circuit board, with the planar conductive layer 302 comprising copper or other suitable conductive metal.

The conductive layer 302 comprises a conductive region 308 and three non-conductive regions (discussed below). In contrast to the conductive region 308, the non-conductive region is devoid of conductive metal. Typically, the non-conductive region is implemented via suitable printed circuit board etching techniques. As shown, the non-conductive regions, together with the surrounding conductive region 308, define a first slot-strip structure 312, a second slot-strip structure 314 that is electrically coupled to the first slot-strip structure 312, and a third slot-strip structure 316 that is electrically coupled to the second slot-strip structure 314.

The conductive-region 308 comprises a first L-shaped arm 318 (comprising a first linear (straight) minor arm portion 318*a* and a first linear (straight) major arm portion 318*b*); a second L-shaped arm 320 (comprising a second linear (straight) minor arm portion 320*a* and a second linear (straight) major arm portion 320*b*); a first linear (straight) arm 322 and a second linear (straight) arm 324. The conductive-region 308 also comprises a first rectangular base portion 326 that extends substantially perpendicularly between the first major arm portion 318 and the second major arm portion 320*b* of the L-shaped arms 318, 320; a second rectangular base portion 328 that extends substantially perpendicularly between the second major arm portion 320*b* and the first linear arm 322; and a third rectangular base portion 330 that extends substantially perpendicularly between the first and second linear arms 322, 324.

The non-conductive region comprises a first non-conductive slot 332 (comprising first minor slot portion 332*a* and first major slot portion 332*b*), a second non-conductive slot 334 (comprising second minor slot portion 334*a* and second major slot portion 334*b*), and a third non-conductive slot 336.

The first non-conductive slot 332 has a substantially L-shape, and extends between the first and second L-shaped arms 318, 320, terminating at the first base portion 326. The second non-conductive slot 334 also has a substantially L-shape, and extends between the second L-shaped arm 320, the third base portion 330 and the first linear arm 322, terminating at the second base portion 332. The third non-conductive slot 336 has a substantially linear (straight) shape, and extends between the first and second linear arms 322, 324, terminating at the third base portion 330.

The first slot-strip structure 312 comprises the first L-shaped arm 318, the first base portion 326, the second base portion 328 and the first non-conductive slot 332. The second slot-strip structure 314 comprises the second L-shaped arm 320, the second base portion 328, the first linear arm 322, and the second non-conductive slot 334. The third slot-strip structure 316 comprises the first linear arm 322, the third base portion 330, the second linear arm 324, and the third non-conductive slot 336.

With this configuration, the first and second slot-strip structures 312, 314 are commonly coupled by the second L-shaped arm 320. Also, the second and third slot-strip structures 314, 316 are commonly coupled by the first linear arm 322. Further, the first, second and third slot-strip structures 312, 314, 316 are substantially U-shaped.

As shown, the multi-band slot-strip antenna 300 also includes a signal feed pin 304, and first and second signal grounding pins 306*a*, 306*b*. The signal feed pin 304 is connected to the first minor arm portion 318*a* of the first slot-strip structure 312, 314, in close proximity to the open end of the first non-conductive slot 332. The first signal ground pin 306*a* is connected to the second minor arm portion 320*a* of the first and second slot-strip structures 312, 314, in close proximity to the signal feed pin 304 and the open end of the first non-conductive slot 332. The first signal ground pin 306*a* is also proximate the third base portion 330 of the third slot-strip structure 316.

The second signal ground pin 306*b* is connected to the second linear arm 324 of the third slot-strip structure 316, in close proximity to the open end of the third non-conductive slot 336. As will become apparent, this second signal ground pin 306*b* extends the bandwidth of the lower frequency band of the multi-band slot-strip antenna 300 to cover most of the application bands at/near 2 GHz.

Preferably, the first minor arm portion 318*a* is substantially parallel to the second minor arm portion 320*a*; and the first major arm portion 318*b* is substantially parallel to the second major arm portion 320*b*. Further, preferably the first linear arm 322 is substantially parallel to the second major arm portion 320*b*, and the second linear arm 324 is substantially parallel to the first linear arm 322.

Similarly, the first minor slot portion 332*a* is substantially parallel to the second minor slot portion 334*a*. Similarly, preferably the first major slot portion 332*b* is substantially parallel to the second major slot portion 334*b*. Further, the second non-conductive slot 334 opens in substantially the same direction as the first non-conductive slot 332.

The third non-conductive slot 336 is preferably substantially parallel to the second major slot portion 334*b* of the second non-conductive slot 334. However, the third non-conductive slot 336 opens in a direction that is substantially opposite to that of the second non-conductive slot 334.

Further, preferably the first and second minor arm portions 318*a*, 320*a*, the first and second minor slot portions 332*a*, 334*a*, and the rectangular base portions 326, 328, 330 are parallel to one pair of opposing edges of the conductive layer 302. In addition, preferably the first and second major arm portions 318*b*, 320*b*, the first and second linear arms 322, 324 and the rectangular base portions 326, 328, 330 are parallel to the other pair of opposing edges of the conductive layer 302.

FIG. 4 to 8 are computer simulations of the return loss for the multi-band slot-strip antenna 300. In these simulations:

$L_a$ is the length of the first major slot portion 332*b*

$L_b$ is the length of the second major slot portion 334*b*

$L_c$ is the length of the third non-conductive slot 336

$h_a$ is the width of the first major slot portion 332*b*

$h_b$ is the width of the second major slot portion 334*b*

$h_c$ is the width of the third non-conductive slot 336

Figure 4:
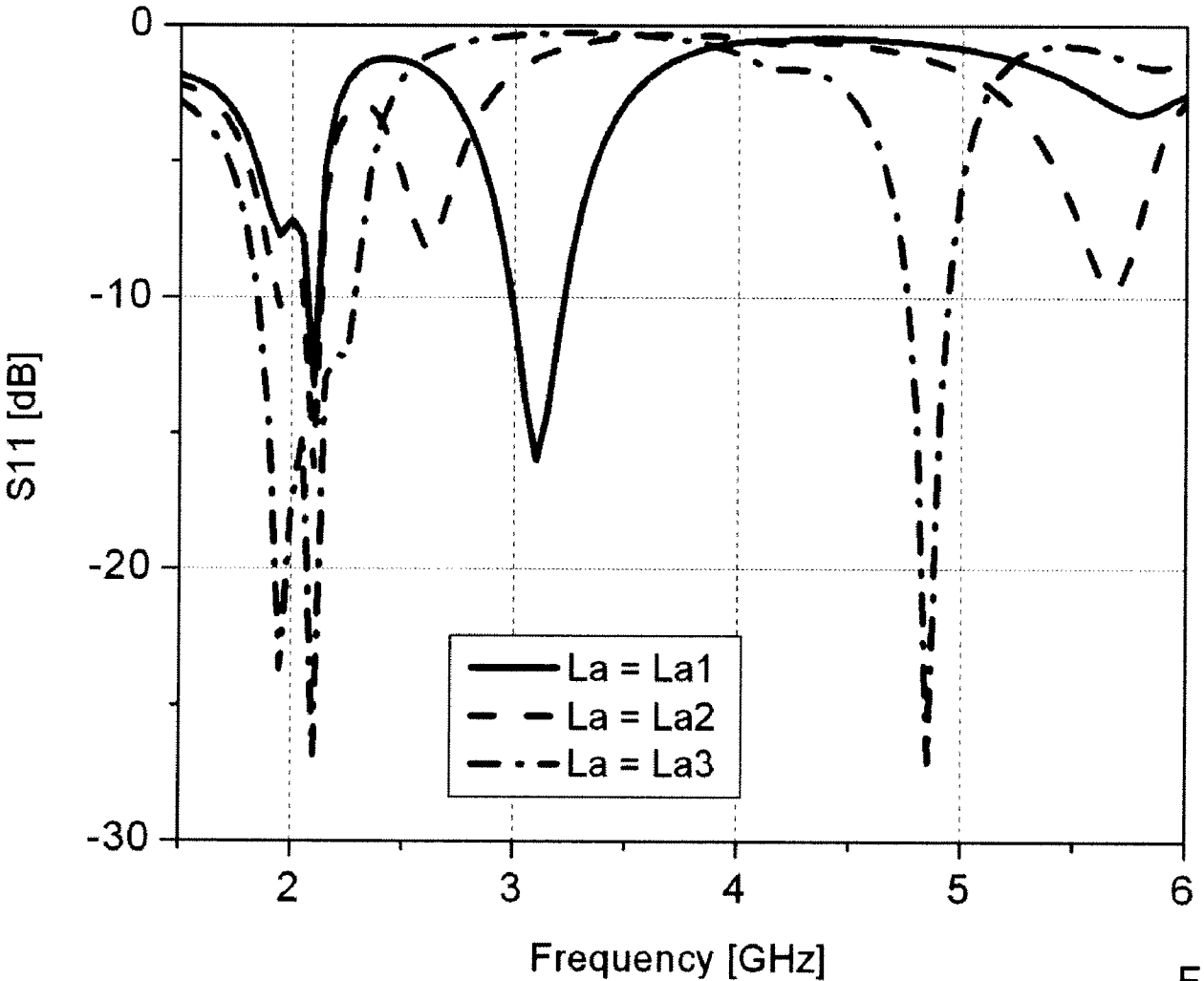
FIG. 4 to 6 are computer simulations of the return loss for the multi-band slot-strip antenna.

FIG. 4 depicts the variation in return loss of the multi-band slot-strip antenna 300 with length $L_a$. In this simulation, $L_b$=28.5 mm; $L_c$=6.5 mm; $h_a$=1 mm; $h_b$=2 mm; $h_c$=2 mm; and La3>La2>La1. This simulation reveals that the length of the first major slot portion 332*b* has a preferential impact on the centre frequency and impedance of the lower frequency band, in comparison to the higher frequency band. This result is advantageous since it reveals that the frequency and impedance of the lower frequency band can be adjusted by varying the length of the first slot-strip structure 312, without significantly impacting the characteristics of the upper frequency band.

Figure 5:
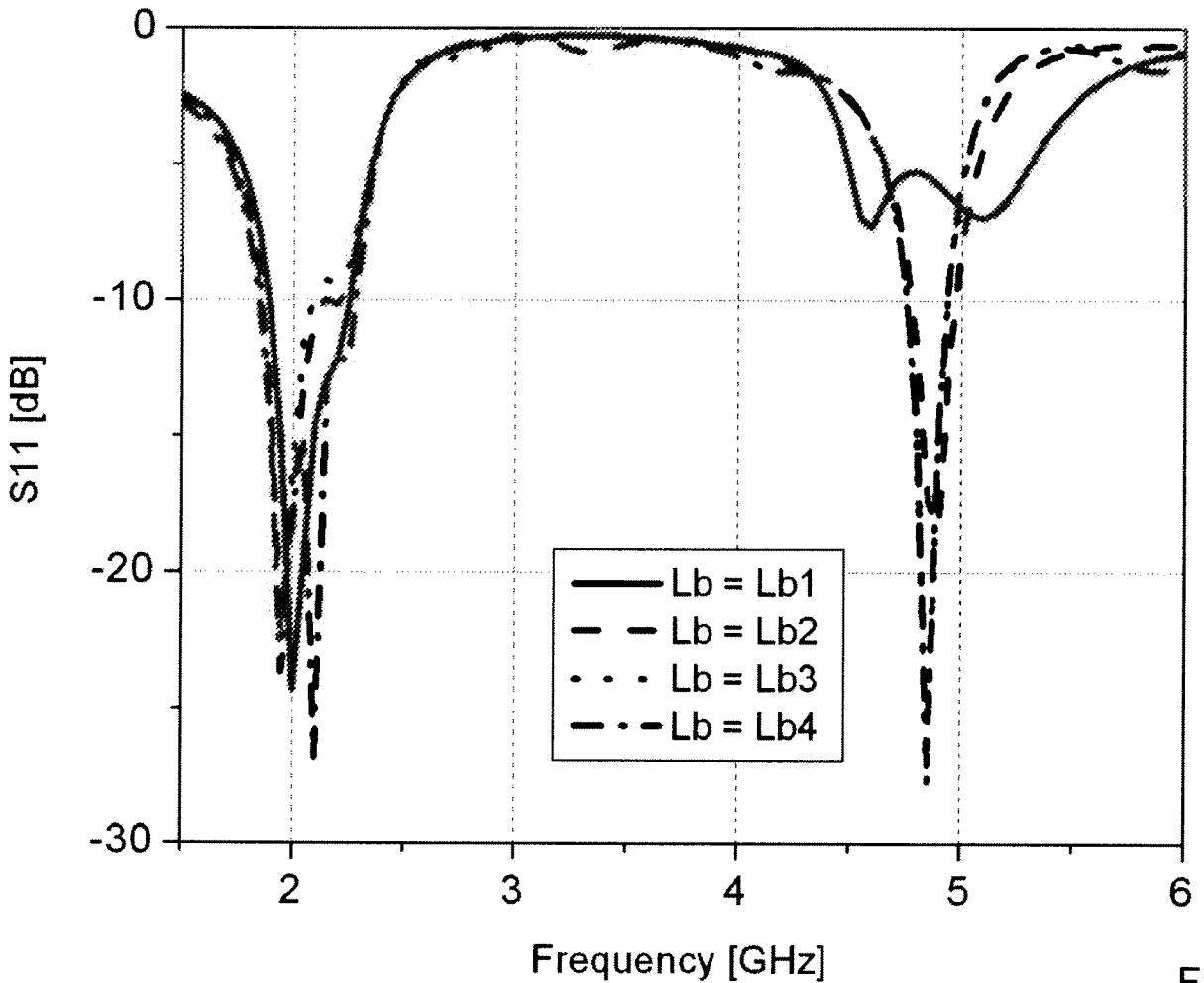

FIG. 5 depicts the variation in return loss with length $L_b$. In this simulation, $L_a$=13.5 mm; $L_c$=6.5 mm; $h_a$=1 mm; $h_b$=2 mm; $h_c$=2 mm; and Lb4>Lb3>Lb2>Lb1. This simulation reveals that the centre frequency, impedance and bandwidth of the upper and lower frequency bands are sensitive to variations in the length of the second major slot portion 334*b*.

Figure 6:
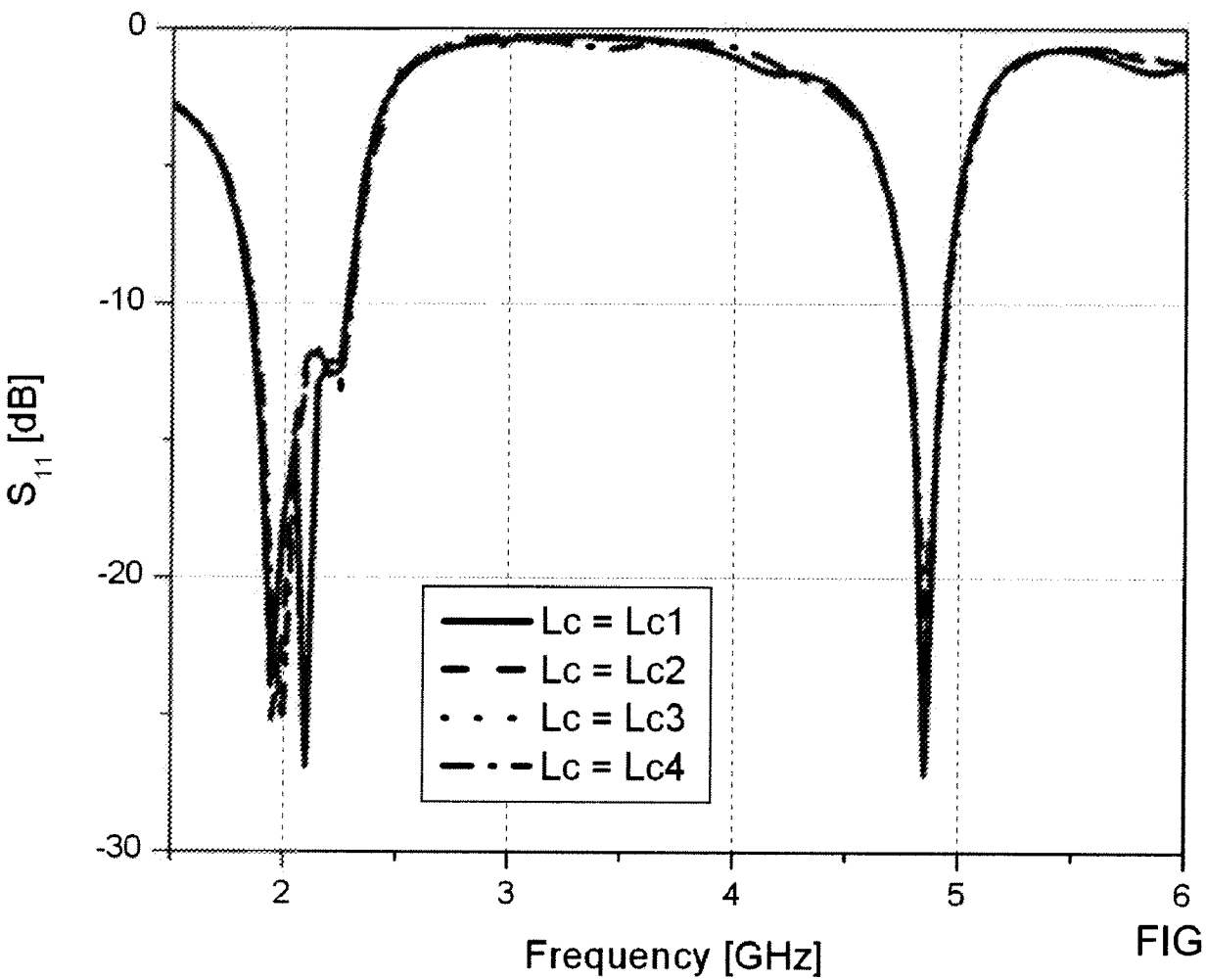

FIG. 6 depicts the variation in return loss with $L_c$. In this simulation, $L_a$=13.5 mm; $L_b$=28.5 mm; $h_a$=1 mm; $h_b$=2 mm; $h_c$=2 mm; and Lc1>Lc2>Lc3>Lc4. This simulation reveals that the impedance of the upper and lower frequency bands is sensitive to variations in the length of the third non-conductive slot 336. This result is advantageous since it reveals that the impedance of both bands can be adjusted independently of the centre frequency and bandwidth of the upper and lower frequency bands.

Figure 7:
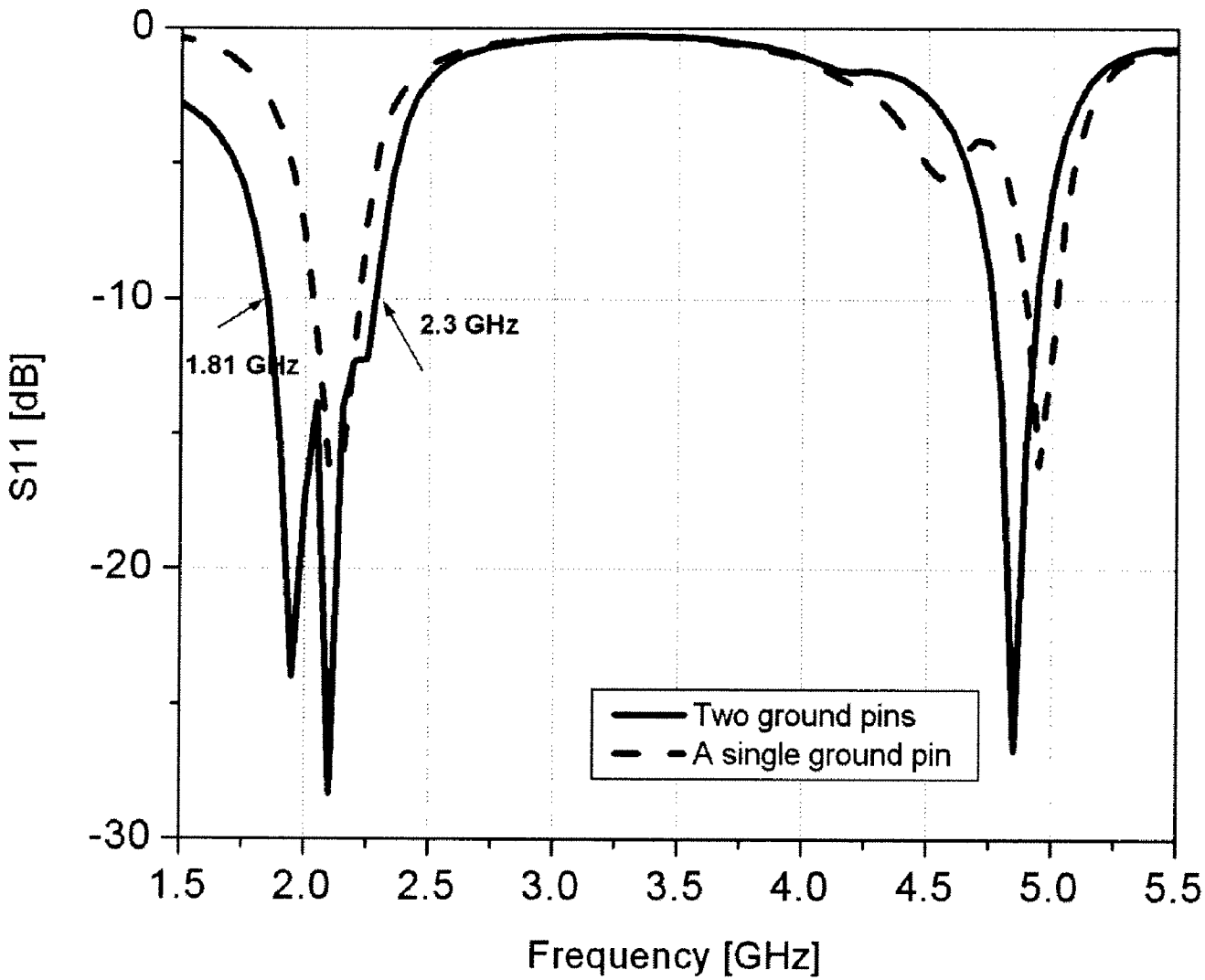
FIG. 7 is a computer simulation of the return loss for a preferred implementation of the multi-band slot-strip antenna.

FIG. 7 is a computer simulation of the return loss for a preferred implementation of the multi-band slot-strip antenna 300, in comparison to a structure which has the same shape and dimensions but lacks the second signal grounding pin 306*b*. In this simulation, $L_a$=13.5 mm; $L_b$=28.5 mm; $L_c$=6.5 mm; $h_a$=1 mm; $h_b$=2 mm; $h_c$=2 mm. This simulation reveals that the second signal grounding pin 306*b* adds two closely-spaced resonant frequencies to the simulated spectrum around 2 GHz, which significantly increases the bandwidth of the low frequency range from about 250 MHz to about 500 MHz.

Figure 8:
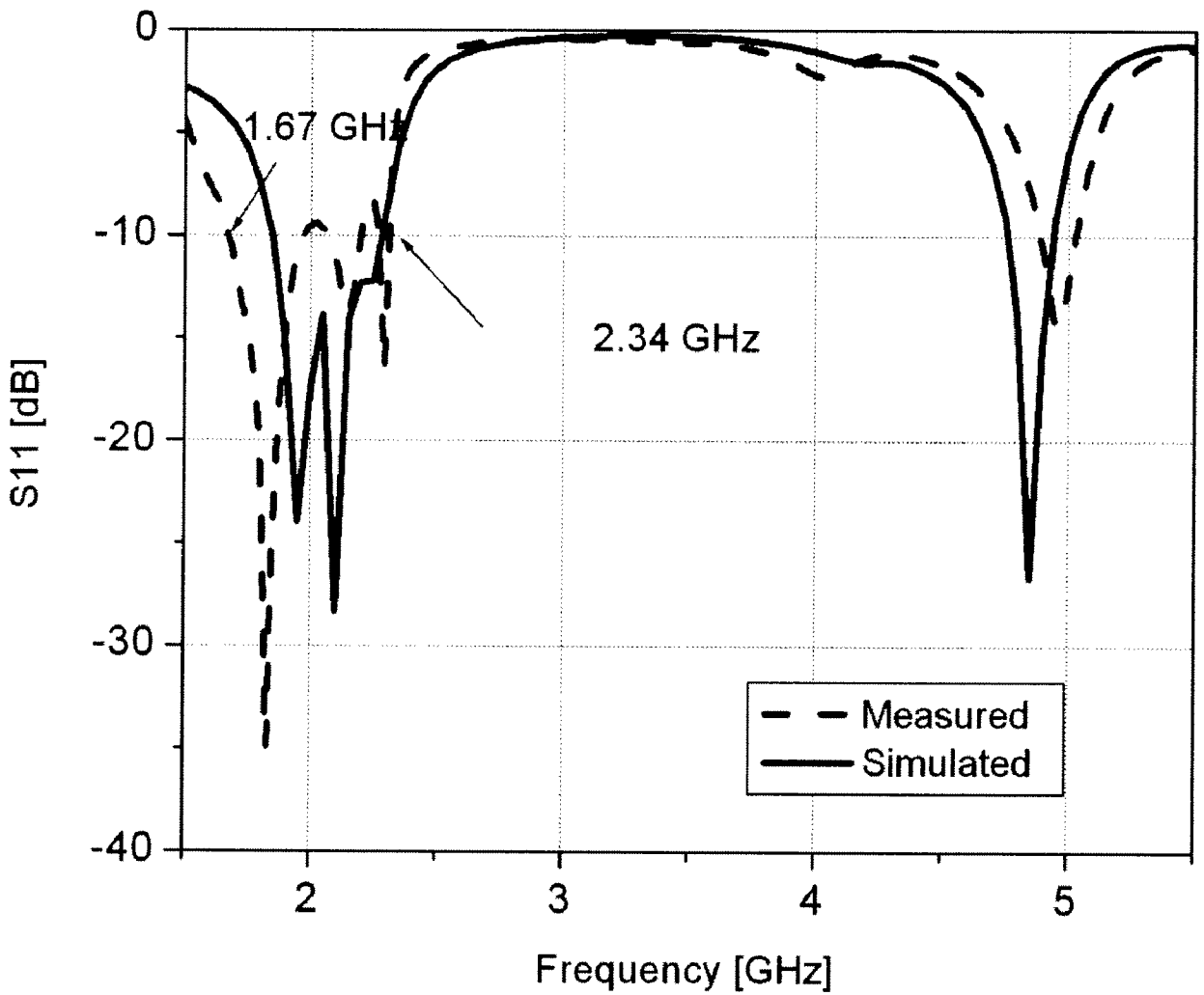
FIG. 8 depicts the computer simulated and actual return loss for the preferred implementation of the multi-band slot-strip antenna.

FIG. 8 depicts the computer simulated and actual performance of a secondary multi-band slot-strip antenna 300 having the following dimensions: $L_a$=13.5 mm; $L_b$=28.5 mm; $L_c$=6.5 mm; $h_a$=1 mm; $h_b$=2 mm; $h_c$=2 mm. This graph reveals that the multi-band slot-strip antenna 300 has an actual low frequency range that extends from 1.67 GHz to 2.34 GHz. Since the GSM1800 band (1710-1880 MHz), the GSM1900 band (1850-1990 MHz), the DCS band (1710-1880 MHz), the PCS band (1880-1990 MHz), and the UMTS band (1900-2200 MHz) all fall within this enhanced low frequency range of the multi-band slot-strip antenna 300, the introduction of the second signal grounding pin 306*b* significantly enhances the multi-band performance of the multi-band slot-strip antenna 300. The graph also reveals that the multi-band slot-strip antenna 300 has a higher frequency (5 GHz) range that is suitable for WLAN 802.11 a/j applications.

As will be appreciated from the foregoing discussion, the multi-band antenna 300 offers enhanced low frequency bandwidth around 2 GHz suitable for 3G communications. This result is obtained in a structure whose size is suitable for incorporation into small handheld communications devices.

The scope of the monopoly desired for the invention is defined by the claims appended hereto, with the foregoing description being merely illustrative of the preferred embodiment of the invention. Persons of ordinary skill may envisage modifications to the described embodiment which, although not explicitly suggested herein, do not depart from the scope of the invention, as defined by the appended claims.

We claim:

1. A multi-band slot-strip antenna comprising:

a planar conductive layer comprising a conductive region and a non-conductive region, the conductive region and the non-conductive region together defining:

a first slot-strip structure comprising a signal feed portion;

a second slot-strip structure coupled to the first slot-strip structure, the second slot-strip structure comprising a first signal grounding portion; and a third slot-strip structure coupled to the second slot-strip structure, the third slot-strip structure comprising a second signal grounding portion, the signal feed portion being coupled to the radio transceiver section, the second signal grounding portion being distinct from the first signal grounding portion, wherein the slot-strip structures each have a substantially U-shape, each said U-shaped slot-strip structure comprises a pair of arms, abuse portion joining together the arms, and a slot extending between the arms, the signal feed portion and the grounding portions are each disposed on one arm of the respective slot-strip structures, another arm of the first slot-strip structure is common with the one arm of the second slot-strip structure, another arm of the second slot-strip structure is common with another arm of the third slot-strip structure, and the second signal grounding portion is provided on another arm of the third slot-strip structure.

2. The multi-band antenna according to claim 1, wherein the slot of the third slot-strip structure opens in a direction opposite to that of the second slot-strip structure.

3. The multi-band antenna according to claim 1, wherein the slot of the second slot-strip structure opens in a direction substantially the same as the first slot-strip structure.

4. The multi-band antenna according to claim 3, wherein the first grounding portion is disposed proximate the signal feed portion.

5. The multi-band antenna according to claim 4, wherein the first grounding portion is disposed proximate the base portion of the third slot-strip structure.

6. The multi-band antenna according to claim 2, wherein the first grounding portion is disposed proximate the signal feed portion.

7. The multi-band antenna according to claim 6, wherein the first grounding portion is disposed proximate the base portion of the third slot-strip structure.

8. The multi-band antenna according to claim 1, wherein the arms of the first slot-strip structure have a substantially L-shape.

9. The multi-band antenna according to claim 8, wherein one arm of the second slot-strip structure has a substantially L-shape, and the other arm of the second slot-strip structure has a substantially linear shape.

10. The multi-band antenna according to claim 1, wherein the signal feed portion and the signal ground portions are provided adjacent an end of the respective arms opposite the respective base portions.

11. A wireless communications device comprising:

a radio transceiver section; and a multi-band slot-strip antenna coupled to the radio transceiver section, the multi-band antenna comprising:

a planar conductive layer comprising a conductive region and a central non-conductive region, the conductive region and the non-conductive region together defining:

a first slot-strip structure comprising a signal feed portion;

a second slot-strip structure coupled to the first slot-strip structure, the second slot-strip structure comprising a first signal grounding portion; and a third slot-strip structure coupled to the second slot-strip structure, the third slot-strip structure comprising a second signal grounding portion, the signal feed portion being coupled to the radio transceiver section, the second signal grounding portion being distinct from the first signal grounding portion, wherein the slot-strip structures each have a substantially U-shape, each said U-shaped slot-strip structure comprises a pair of arms, a base portion joining together the arms, and a slot extending between the arms, the signal feed portion and the grounding portions are each disposed on one arm of the respective slot-strip structures, another arm of the first slot-strip structure is common with the one arm of the second slot-strip structure, another arm of the second slot-strip structure is common with another arm of the third slot-strip structure, and the second signal grounding portion is provided on another arm of the third slot-strip structure.

12. The wireless communications device according to claim 11, wherein the slot of the third slot-strip structure opens in a direction opposite to that of the second slot-strip structure.

13. The wireless communications device according to claim 12, wherein the slot of the second slot-strip structure opens in a direction substantially the same as the first slot-strip structure.

14. The wireless communications device according to claim 13, wherein the first grounding portion is disposed proximate the signal feed portion.

15. The wireless communications device according to claim 14, wherein the first grounding portion is disposed proximate the base portion of the third slot-strip structure.

16. The wireless communications device according to claim 12, wherein the first grounding portion is disposed proximate the signal feed portion.

17. The wireless communications device according to claim 16, wherein the first grounding portion is disposed proximate the base portion of the third slot-strip structure.

18. The wireless communications device according to claim 11, wherein the arms of the first slot-strip structure have a substantially L-shape.

19. The wireless communications device according to claim 11, wherein the signal feed portion and the signal ground portions are provided adjacent an end of the respective arms opposite the respective base portions.

20. A multi-band slot-strip antenna comprising:

a planar conductive layer comprising a conductive region and a central non-conductive region, the conductive region and the non-conductive region together defining at least three mutually-coupled slot-strip structures;

a feed signal pin connected to a first of the slot-strip structures;

a first ground pin connected to a second of the slot-strip structures; and a second ground pin connected to a third of the slot-strip structures, the grounding pins being distinct from each other, wherein the slot-strip structures each have a substantially U-shape, each said U-shaped slot-strip structure comprises a pair of arms, a base portion joining together the arms, and a slot extending between the arms, the feed signal pin and the ground pins are each disposed on one arm of the respective slot-strip structures, another arm of the first slot-strip structure is common with the one arm of the second slot-strip structure, another arm of the second slot-strip structure is common with another arm of the third slot-strip structure, and the second ground pin is provided on another arm of the third slot-strip structure.

* * * * *